US008213621B2

(12) United States Patent
Bruno et al.

(10) Patent No.: US 8,213,621 B2
(45) Date of Patent: Jul. 3, 2012

(54) METHOD AND DEVICE FOR CONTROLLING A REPRODUCTION UNIT USING A MULTI-CHANNEL

(75) Inventors: Rémy Bruno, Vitry sur Seine (FR); Arnaud Laborie, Vitry sur Seine (FR); Sébastien Montoya, Paris (FR)

(73) Assignee: Trinnov Audio, Villejuif (FR)

( * ) Notice: Subject to any disclaimer, the term of this patent is extended or adjusted under 35 U.S.C. 154(b) by 868 days.

(21) Appl. No.: 10/542,774

(22) PCT Filed: Jan. 20, 2004

(86) PCT No.: PCT/FR2004/000115

§ 371 (c)(1),
(2), (4) Date: Jan. 18, 2006

(87) PCT Pub. No.: WO2004/068463

PCT Pub. Date: Aug. 12, 2004

(65) Prior Publication Data

US 2006/0167963 A1 Jul. 27, 2006

(30) Foreign Application Priority Data

Jan. 20, 2003 (FR) ..... 03 00571

(51) Int. Cl.
*H04R 5/00* (2006.01)

(52) U.S. Cl. ..... 381/17; 700/94; 381/310

(58) Field of Classification Search ..... 381/17–19, 381/61, 63, 56, 307, 98; 700/94
See application file for complete search history.

(56) References Cited

U.S. PATENT DOCUMENTS

| | | | | |
|---|---|---|---|---|
| 4,060,850 | A * | 11/1977 | Speiser | 708/813 |
| 5,333,200 | A * | 7/1994 | Cooper et al. | 381/1 |
| 5,757,927 | A * | 5/1998 | Gerzon et al. | 381/20 |
| 6,154,549 | A * | 11/2000 | Arnold et al. | 381/104 |
| 7,158,643 | B2 * | 1/2007 | Lavoie et al. | 381/58 |
| 7,167,566 | B1 * | 1/2007 | Bauck | 381/17 |
| 7,394,904 | B2 * | 7/2008 | Bruno et al. | 381/61 |
| 2002/0172370 | A1 * | 11/2002 | Ito | 381/18 |

FOREIGN PATENT DOCUMENTS

| | | | |
|---|---|---|---|
| JP | 11-168792 | * | 6/1996 |
| JP | 2000-261900 | | 9/2000 |
| JP | 2000-354300 | | 12/2000 |

* cited by examiner

*Primary Examiner* — Xu Mei
*Assistant Examiner* — Lun-See Lao
(74) *Attorney, Agent, or Firm* — Young & Thompson

(57) ABSTRACT

A method of controlling a sound field reproduction unit (2) having numerous reproduction elements (3*n*), uses a plurality of sound information input signals (SI) which are each associated with a general pre-determined reproduction direction which is defined in relation to a given point (5). The method includes: determining parameters which are representative of the position of the elements (3*n*) in the three spatial dimensions; determining matching filters (A) from the spatial characteristics and the general pre-determined reproduction directions; determining control signals by applying the aforementioned filters to the sound information input signals (SI); and delivering control signals for application to the above-mentioned reproduction elements (3*n*).

28 Claims, 7 Drawing Sheets

FIG. 4
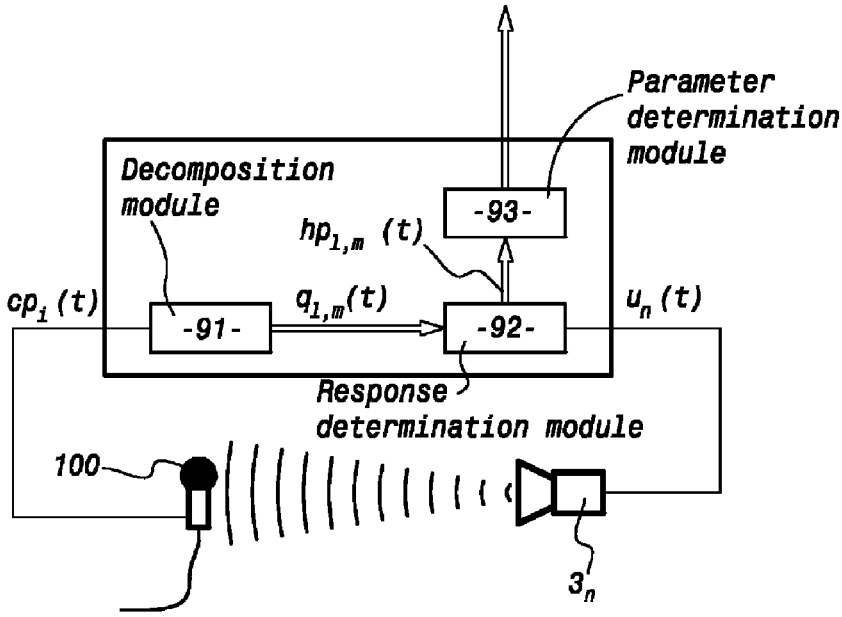
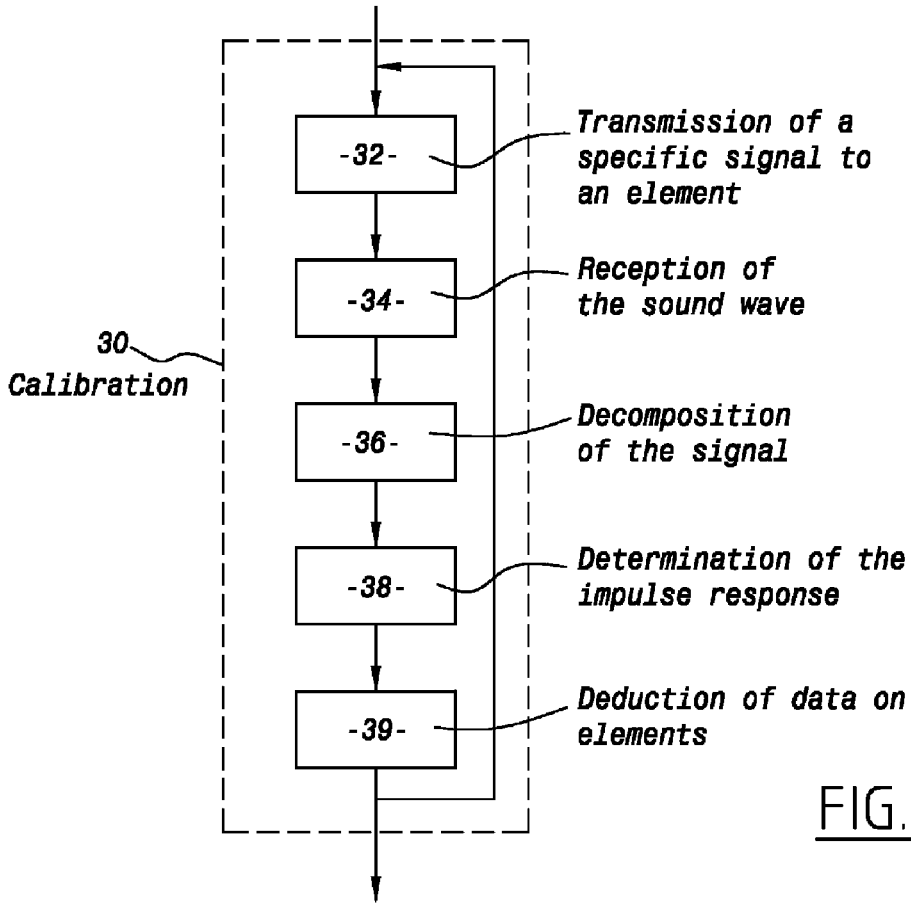
FIG. 5

METHOD AND DEVICE FOR CONTROLLING A REPRODUCTION UNIT USING A MULTI-CHANNEL

The present invention relates to a method and a device for controlling a sound field reproduction unit comprising a plurality of reproduction elements, using a plurality of sound or audiophonic signals each associated with a predetermined general reproduction direction defined relative to a given point in space.

Such a set of signals is commonly referred to by the expression "multi-channel signal" and corresponds to a plurality of signals, called channels, which are transmitted in parallel or multiplexed with each other and each of which is intended for a reproduction element or a group of reproduction elements, arranged in a general direction predefined relative to a given point.

For example, a conventional multi-channel system is known under the name "5.1 ITU-R BF 775-1" and comprises five channels intended for reproduction elements placed in five predetermined general directions relative to a listening centre, which directions are defined by the angles 0°, +30°, −30°, +110° and −110°.

Such an arrangement therefore corresponds to the arrangement of a loudspeaker or a group of loudspeakers at the front in the centre, one on each side at the front on the right and the left and one on each side at the rear on the right and the left.

Since the control signals are each associated with a specific direction, the application of these signals to a reproduction unit whose elements do not correspond to the predetermined spatial configuration brings about substantial deformation of the sound field reproduced.

There are systems which incorporate delay means on the channels in order to compensate at least partially for the distance between the reproduction elements and the listening centre. However, these systems do not enable the arrangement of the reproduction unit in space to be taken into account.

It therefore appears that no existing method or system permits high-quality reproduction using a signal of the multi-channel type with a reproduction unit having any spatial configuration.

An object of the present invention is to overcome this problem by defining a method and a system for controlling the reproduction unit whose spatial configuration may be of any type.

The invention relates to a method for controlling a sound field reproduction unit comprising a plurality of reproduction elements each associated with a predetermined general reproduction direction defined relative to a given point, in order to obtain a reproduced sound field of specific characteristics that are substantially independent of the intrinsic reproduction characteristics of the unit, characterized in that the method comprises:

- a step for determining at least spatial characteristics of the reproduction unit, permitting the determination of parameters that are representative, in the case of at least one element of the reproduction unit, of its position in the three spatial dimensions relative to the given point;
- a step for determining adaptation filters using the at least spatial characteristics of the reproduction unit and the predetermined general reproduction directions associated with the plurality of sound data input signals;
- a step for determining at least one signal for controlling the elements of the reproduction unit by applying the adaptation filters to the plurality of sound data input signals; and
- a step for providing the at least one control signal with a view to application to the reproduction elements.

According to other features:

- the step for determining at least spatial characteristics of the reproduction unit comprises an acquisition sub-step enabling all or some of the characteristics of the reproduction unit to be determined;
- the step for determining at least spatial characteristics of the reproduction unit comprises a calibration step enabling all or some of the characteristics of the reproduction unit to be provided;
- the calibration sub-step comprises, in the case of at least one of the reproduction elements:
  - a sub-step for transmitting a specific signal to the at least one element of the reproduction unit;
  - a sub-step for acquiring the sound wave emitted in response by the at least one element;
  - a sub-step for converting the acquired signals into a finite number of coefficients representative of the emitted sound wave; and
  - a sub-step for determining spatial and/or sound parameters of the element on the basis of the coefficients representative of the emitted sound wave;
- the calibration sub-step also comprises a sub-step for determining the position in at least one of the three spatial dimensions of the at least one element of the reproduction unit;
- the calibration step comprises a sub-step for determining the frequency response of the at least one element of the reproduction unit;
- the step for determining adaptation filters comprises:
  - a sub-step for determining a decoding matrix representative of filters permitting compensation for the changes in reproduction caused by the spatial characteristics of the reproduction unit;
  - a sub-step for determining an ideal multi-channel radiation matrix representative of the predetermined general directions associated with each data signal of the plurality of input signals; and
- a sub-step for determining a matrix representative of the adaptation filters using the decoding matrix and the multi-channel radiation matrix;
- the step for determining adaptation filters comprises a plurality of calculation sub-steps providing a limit order of spatial precision of the adaptation filters, a matrix corresponding to a spatial window representative of the distribution in space of the desired precision during the reconstruction of the sound field and a matrix representative of the radiation of the reproduction unit, the sub-step for calculating the decoding matrix being carried out using the results of these calculation sub-steps;
- the matrices for decoding, ideal multi-channel radiation and adaptation are independent of the frequency, the step for determining at least one signal for controlling the elements of the reproduction unit by applying the adaptation filters corresponding to simple linear combinations followed by a delay;
- the step for determining characteristics of the reproduction unit permits the determination of sound characteristics of the reproduction unit and the method comprises a step for determining compensation filters for these sound characteristics, the step for determining at least one control signal then comprising a sub-step for applying the sound compensation filters;
- the step for determining sound characteristics is suitable for providing parameters that are representative, in the case of at least one element, of its frequency response;
- the step for determining at least one control signal comprises a sub-step for adjusting the gain and applying delays in order to align temporally the wavefront of the reproduction elements as a function of their distance from the given point.

The invention relates also to a computer program comprising program code instructions for performing the steps of the method when the program is performed by a computer.

The invention relates also to a removable medium of the type comprising at least one processor and a non-volatile memory element, characterized in that the memory comprises a program comprising code instructions for performing the steps of the method, when the processor performs the program.

The invention relates also to a device for controlling a sound field reproduction unit comprising a plurality of reproduction elements, comprising input means for a plurality of sound data input signals each associated with a predetermined general reproduction direction defined relative to a given point, characterized in that it also comprises:

- means for determining at least spatial characteristics of the reproduction unit, permitting the determination of parameters that are representative, in the case of at least one element of the reproduction unit, of its position in the three spatial dimensions relative to the given point;
- means for determining adaption filters using the at least spatial characteristics of the reproduction unit and the predetermined general reproduction directions associated with the plurality of sound data input signals; and
- means for determining at least one signal for controlling the elements of the reproduction unit by applying the adaptation filters to the plurality of sound data input signals.

According to other features of this device:

- the means for determining the at least spatial characteristics of the reproduction unit comprise means for the direct acquisition of the characteristics;
- it is suitable for being associated with calibration means permitting the determination of the at least spatial characteristics of the reproduction unit;
- the calibration means comprise means for acquiring a sound wave which comprise four pressure sensors arranged in accordance with a general tetrahedral shape;
- the means for determining characteristics are suitable for determining sound characteristics of at least one of the reproduction elements of the reproduction unit, the device comprising means for determining sound compensation filters using the sound characteristics, and the means for determining at least one control signal being suitable for applying the sound compensation filters;
- the means for determining the sound characteristics are suitable for determining the frequency response of the elements of the reproduction unit.

The invention relates also to an apparatus for processing audio and video data, comprising means for determining a plurality of sound data input signals each associated with a predetermined general reproduction direction defined by a given point, characterized in that it also comprises a device for controlling a reproduction unit;

- the means for determining a plurality of input signals are formed by a unit for reading and decoding digital audio and/or video discs.

The invention will be better understood on reading the following description which is given purely by way of example and with reference to the appended drawings in which FIG. 1 is a representation of a spherical coordinate system;

FIG. 4 is a diagram of calibration means used in the method of the invention;

FIG. 5 is a detailed flow chart of the calibration step;

This coordinate system is an orthonormal coordinate system having an origin O and comprising three axes (OX), (OY) and (OZ).

In this coordinate system, a position indicated $\vec{x}$ is described by means of its spherical coordinates $(r,\theta,\phi)$, where r denotes the distance relative to the origin O, $\theta$ the orientation in the vertical plane and $\phi$ the orientation in the horizontal plane.

In such a coordinate system, a sound field is known if the sound pressure indicated $p(r,\theta,\phi,t)$, whose temporal Fourier transform is indicated $P(r,\theta,\phi,f)$ where f denotes the frequency, is defined at all points at each instant t.

The invention is based on the use of a family of spatio-temporal functions enabling the characteristics of any sound field to be described.

In the embodiment described, these functions are what are known as spherical Fourier-Bessel functions of the first kind which will be referred to hereinafter as Fourier-Bessel functions.

In a region empty of sound sources and empty of obstacles, the Fourier-Bessel functions are solutions of the wave equation and constitute a basis which generates all the sound fields produced by sound sources located outside this region.

Any three-dimensional sound field is therefore expressed by a linear combination of the Fourier-Bessel functions in accordance with the expression of the inverse Fourier-Bessel transform which is expressed:

$$P(r,\theta,\phi,f)=4\pi\sum_{l=0}^{\infty}\sum_{m=-l}^{l}P_{l,m}(f)j^{l}j_{l}(kr)y_{l}^{m}(\theta,\phi)$$

In this equation, the terms $P_{l,m}(f)$ are, by definition, the Fourier-Bessel coefficients of the field $$p(r,\theta,\phi,t),\ k=\frac{2\pi f}{c},$$

is the speed of sound in air (340 $ms^{-1}$), $j_l(kr)$ is the spherical Bessel function of the first kind and of order l defined by $$j_l(x)=\sqrt{\frac{\pi}{2x}}\,J_{l+1/2}(x)$$

where $J_v(x)$ is the Bessel function of the first kind and of order v, and $y_l^m(\theta,\phi)$ is the real spherical harmonic of order l and of term m, with m ranging from −l to l, defined by:

$$y_l^m(\theta,\phi)=\begin{cases}\frac{1}{\sqrt{\pi}}P_l^{|m|}(\cos\theta)\cos(m\phi) & \text{pour } m>0\\ \frac{1}{\sqrt{2\pi}}P_l^0(\cos\theta) & \text{pour } m=0\\ \frac{1}{\sqrt{\pi}}P_l^{|m|}(\cos\theta)\sin(m\phi) & \text{pour } m<0\end{cases}$$

In this equation, the $P_l^m(x)$ are the associated Legendre functions defined by:

$$P_l^m(x)=\sqrt{\frac{2l+1}{2}}\sqrt{\frac{(l-m)!}{(l+m)!}}(1-x^2)^{m/2}\frac{d^m}{dx^m}P_l(x)$$

with $P_l(x)$ denoting the Legendre polynomials, defined by:

$$P_l(x)=\frac{1}{2^l l!}\frac{d^l}{dx^l}(x^2-1)^l$$

The Fourier-Bessel coefficients are also expressed in the temporal domain by the coefficients $p_{l,m}(t)$ corresponding to the inverse temporal Fourier transform of the coefficients $P_{l,m}(f)$.

In a variant, the method of the invention operates on the basis of functions which are expressed as optionally infinite linear combinations of Fourier-Bessel functions.

Figure 1:
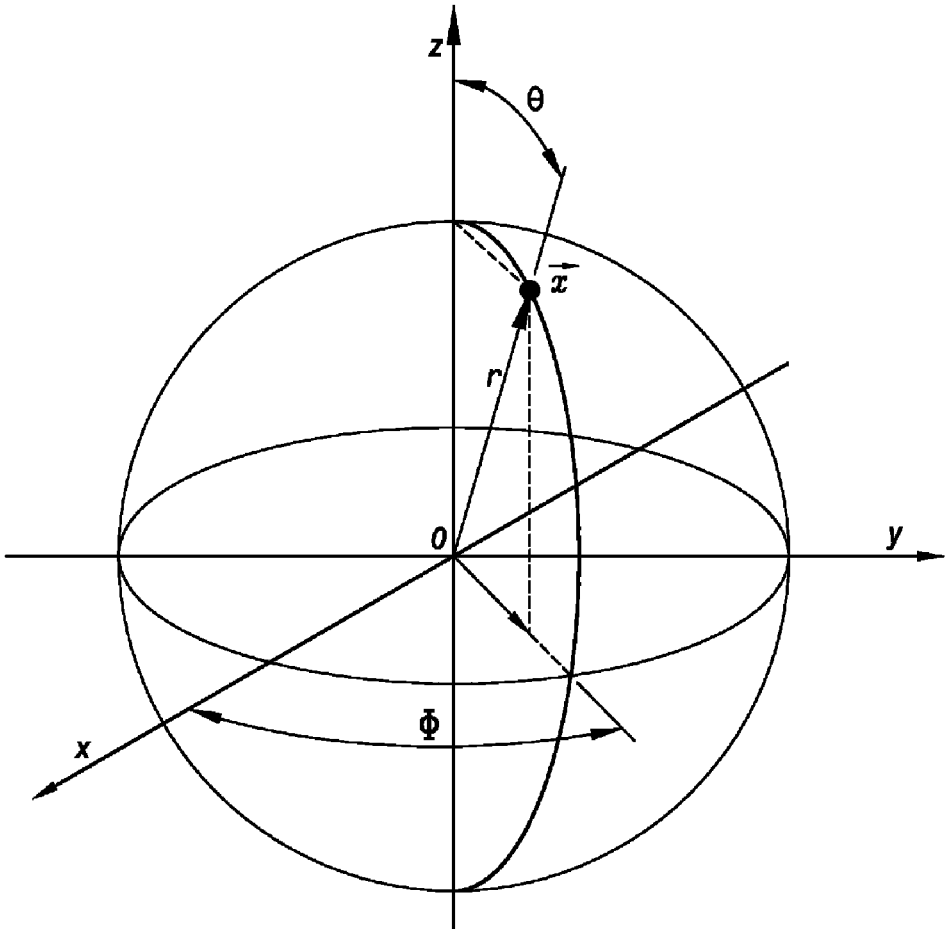
FIG. 1 shows a conventional spherical coordinate system in order to indicate the coordinate system to which reference is made in the text.
Figure 2:
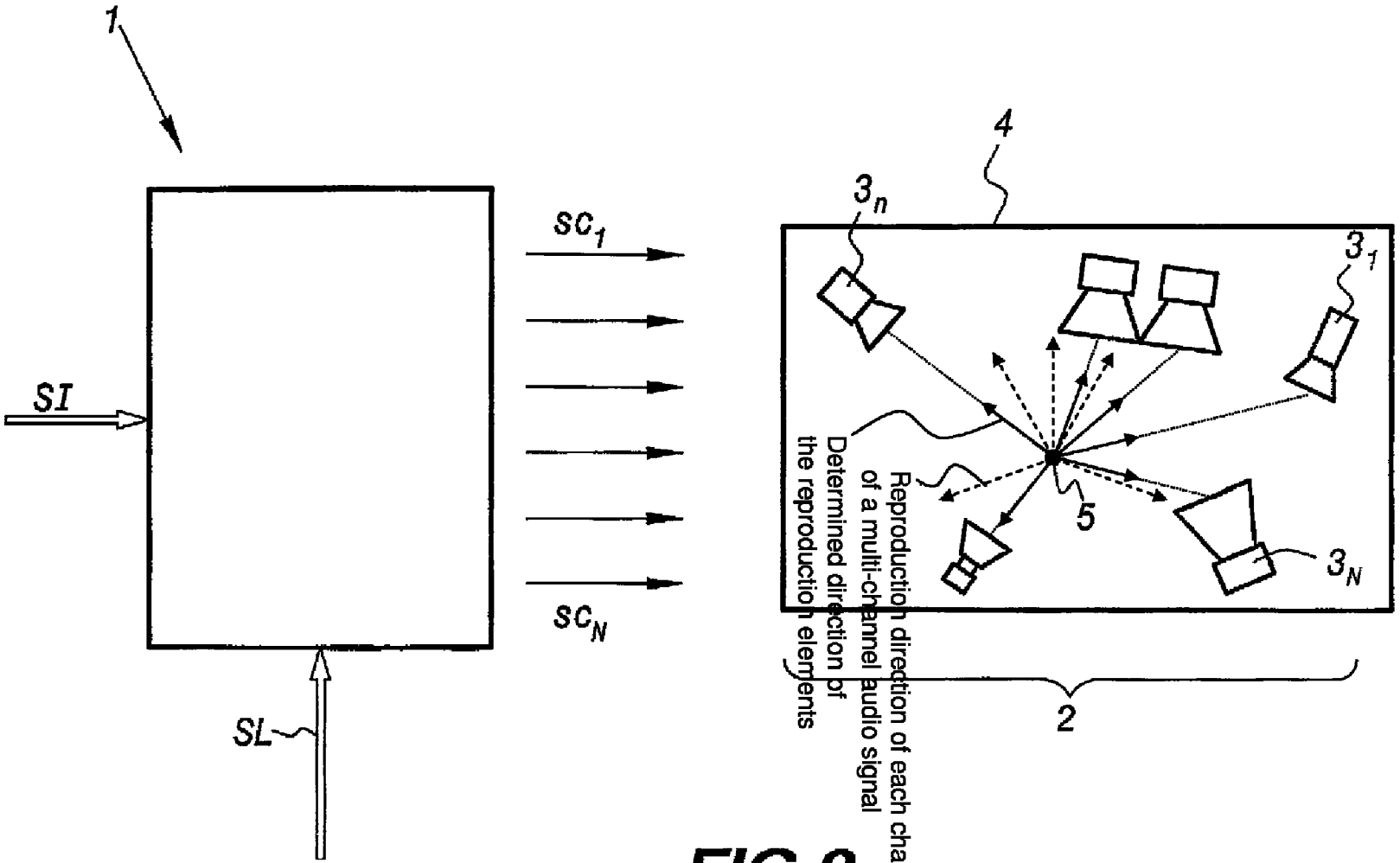
FIG. 2 is a diagram of a reproduction system according to the invention.

FIG. 2 shows diagrammatically a reproduction system in which the method of the invention is used.

This system comprises a decoder or adaptor 1 controlling a reproduction unit 2 which comprises a plurality of elements $\mathbf{3}_1$ to $\mathbf{3}_N$, such as loudspeakers, baffles or any other sound source or group of sound sources, which are arranged in any manner at a listening site 4. The origin O of the coordinate system, which is called the centre 5 of the reproduction unit, is placed arbitrarily in the listening site 4.

The set of spatial, sound and electrodynamic characteristics are regarded as being the intrinsic characteristics of the reproduction unit 2.

The adaptor 1 receives as an input a signal SI of the multi-channel type comprising sound data to be reproduced and a definition signal SL comprising data representative of at least spatial characteristics of the reproduction unit 2 and permitting, in particular, the determination of parameters that are representative, in the case of at least one element $\mathbf{3}_n$ of the reproduction unit 2, of its position in the three spatial dimensions relative to the given point 5.

At the end of the processing operation corresponding to the method of the invention, the adaptor 1 transmits for the attention of each of the elements or groups of elements $\mathbf{3}_1$ to $\mathbf{3}_N$ of the reproduction unit 2, a specific control signal $sc_1$ to $sc_N$.

Figure 3:
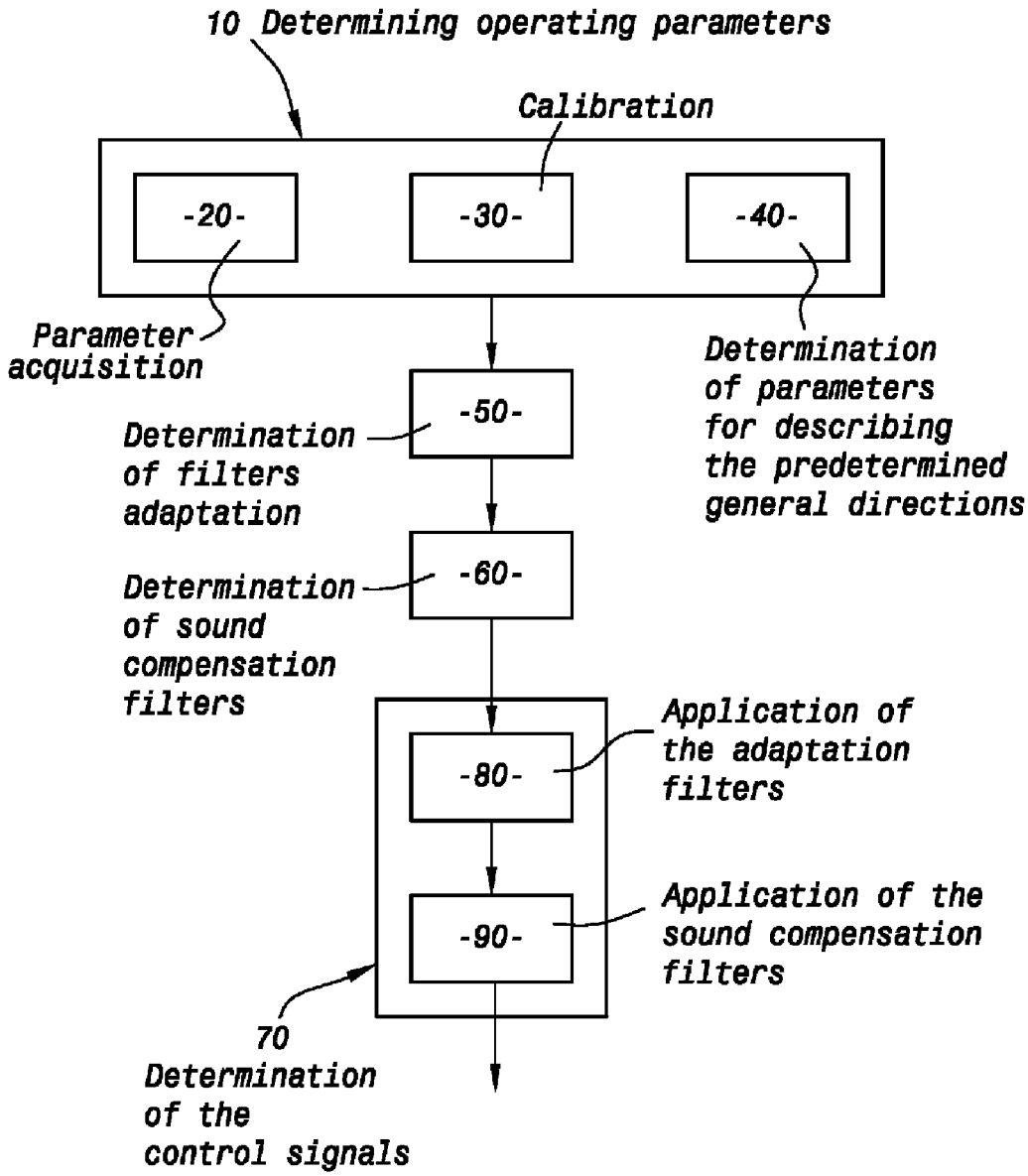
FIG. 3 is a flow chart of the method of the invention.

FIG. 3 shows diagrammatically the main steps of the method according to the invention used with a reproduction system such as that described with reference to FIG. 2.

This method comprises a step 10 for determining operating parameters which is suitable for permitting at least the determination of the spatial characteristics of the reproduction unit 2.

Step 10 comprises a parameter acquisition step 20 and/or a calibration step 30 enabling characteristics of the reproduction unit 2 to be determined and/or measured.

In the embodiment described, step 10 also comprises a step 40 for determining parameters for describing the predetermined general directions associated with the various channels of the multi-channel input signal SI.

At the end of step 10, data relating at least to the various predetermined general directions associated with each of the input channels as well as the position in the three spatial dimensions of each of the elements or groups of elements $\mathbf{3}_n$ of the reproduction unit 2 are determined.

These data are used in a step 50 for determining the adaptation filters enabling the spatial characteristics of the reproduction unit 2 to be taken into account in order to define filters for adapting the multi-channel input signal to the specific spatial configuration of the reproduction unit 2.

Advantageously, step 10 also enables sound characteristics for all or some of the elements $\mathbf{3}_1$ to $\mathbf{3}_N$ of the reproduction unit 2 to be determined.

In that case, the method comprises a step 60 for determining sound compensation filters enabling the influence of the specific sound characteristics of the elements $\mathbf{3}_1$ to $\mathbf{3}_N$ to be compensated for.

The filters defined in step 50, and advantageously in step 60, can thus be stored in a memory, so that steps 10, 50 and 60 have to be repeated only if the spatial configuration of the reproduction unit 2 and/or the nature of the multi-channel input signal is modified.

The method then comprises a step 70 for determining the control signals $sc_1$ to $sc_N$ intended for the elements of the reproduction unit 2, comprising a sub-step 80 for applying the adaptation filters determined in step 50 to the various channels $c_1(t)$ to $c_Q(t)$ forming the multi-channel input signal SI and advantageously a sub-step 90 for applying the sound compensation filters determined in step 60.

The signals $sc_1$ to $sc_N$ thus provided are applied to the elements $\mathbf{3}_1$ to $\mathbf{3}_N$ of the reproduction unit 2 in order to reproduce the sound field represented by the multi-channel input signal SI with optimum adaptation to the spatial, and advantageously sound, characteristics of the reproduction unit 2.

It therefore appears that, owing to the use of the method of the invention, the characteristics of the reproduced sound field are substantially independent of the intrinsic reproduction characteristics of the reproduction unit 2 and, in particular, of its spatial configuration.

The main steps of the method of the invention will now be described in more detail.

In the parameter acquisition step 20, an operator or a suitable memory system can specify all or some of the calculation parameters and especially:

- parameters $\vec{x}_n$ expressed in the spherical coordinate system by means of the coordinates $r_n$, $\theta_n$, and $\phi_n$ and representative of the position of the elements $\mathbf{3}_n$ relative to the listening centre 5; and/or
- parameters $H_n(f)$ representative of the frequency response of the elements $\mathbf{3}_n$.

This step 20 is implemented by means of an interface of a conventional type, such as a microcomputer or any other appropriate means.

Calibration step 30 as well as means for implementing this step will now be described in more detail.

FIG. 4 shows calibration means in detail. They comprise a decomposition module 91, an impulse response determination module 92 and a calibration parameter determination module 93.

The calibration means are suitable for being connected to a sound acquisition device 100, such as a microphone or any other suitable device, and for being connected in turn to each element $\mathbf{3}_n$ of the reproduction unit 2 in order to sample data on this element.

FIG. 5 shows in detail an embodiment of calibration step 30 which is used by the calibration means described above and which enables characteristics of the reproduction unit 2 to be measured.

In a sub-step 32, the calibration means transmit a specific signal $u_n(t)$ such as an MLS (Maximum Length Sequence) pseudo-random sequence for the attention of an element $\mathbf{3}_n$. The acquisition device 100 receives, in a sub-step 34, the sound wave emitted by the element $\mathbf{3}_n$ in response to receiving the signal $u_n(t)$ and transmits I signals $cp_1(t)$ to $cp_I(t)$ representative of the wave received to the decomposition module 91.

In a sub-step 36, the decomposition module 91 decomposes the signals sensed by the acquisition device 100 into a finite number of Fourier-Bessel coefficients $q_{l,m}(t)$.

Figure 6:
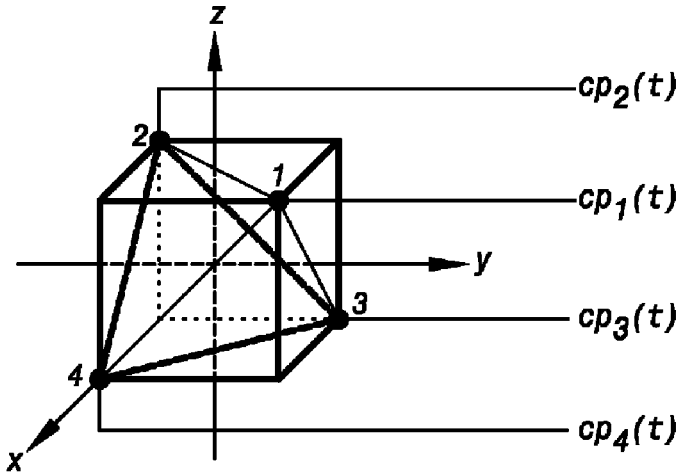
FIG. 6 is a simplified representation of a sensor used for the implementation of the calibration step.

For example, the acquisition device 100 is constituted by 4 pressure sensors located at the 4 apices of a tetrahedron of radius R as shown with reference to FIG. 6. The signals of the 4 pressure sensors are therefore indicated $cp_1(t)$ to $cp_4(t)$. The coefficients $q_{0,0}(t)$ to $q_{1,1}(t)$ representative of the sound field sensed are deduced from the signals $cp_1(t)$ to $cp_4(t)$ in accordance with the following relationships:

$$Q_{0,0}(f) = \frac{1}{\sqrt{4\pi}} \frac{CP_1(f) + CP_2(f) + CP_3(f) + CP_4(f)}{4}$$

$$Q_{1,-1}(f) = -\frac{3}{8\sqrt{\pi}} \frac{c}{2\pi jRf}(CP_1(f) - CP_2(f) + CP_3(f) - CP_4(f))$$

$$Q_{1,0}(f) = \frac{3}{8\sqrt{\pi}} \frac{c}{2\pi jRf}(CP_1(f) + CP_2(f) - CP_3(f) - CP_4(f))$$

$$Q_{1,1}(f) = \frac{3}{8\sqrt{\pi}} \frac{c}{2\pi jRf}(CP_1(f) - CP_2(f) - CP_3(f) + CP_4(f))$$

In these relationships $CP_1(f)$ to $CP_4(f)$ are the Fourier transforms of $CP_1(t)$ to $cp_4(t)$ and $Q_{0,0}(f)$ to $Q_{1,1}(f)$ are the Fourier transforms of $q_{0,0}(t)$ to $q_{1,1}(t)$.

When these coefficients are defined by: the module 91, they are addressed to the response determination module 92.

In a sub-step 38, the response determination module 92 determines the impulse responses $hp_{l,m}(t)$ which link the Fourier-Bessel coefficients $q_{l,m}(t)$ and the transmitted signal $u_n(t)$. The method of determination depends on the specific signal transmitted. The embodiment described uses a method suitable for signals of the MLS type, such as, for example, the correlation method.

The impulse response provided by the response determination module 92 is addressed to the parameter determination module 93.

In a sub-step 39, the module 93 deduces data on elements of the reproduction unit.

In the embodiment described, the parameter determination module 93 determines the distance $r_n$ between the element $\mathbf{3}_n$ and the centre 5 on the basis of its response $hp_{0,0}(t)$ and the measurement of the time taken by the sound to propagate from the element $\mathbf{3}_n$ to the acquisition device 100, by means of methods for estimating the delay in the response $hp_{0,0}(t)$.

The direction $(\theta_n,\phi_n)$ of the element $\mathbf{3}_n$ is deduced by calculating the maximum of the inverse spherical Fourier transform applied to the responses $hp_{0,0}(t)$ to $hp_{1,1}(t)$ taken at the instant t where $hp_{0,0}(t)$ is at a maximum. Advantageously, the coordinates $\theta_n$ and $\phi_n$ are estimated at several instants, preferably chosen around the instant where $hp_{0,0}(t)$ is at a maximum. The final determination of the coordinates $\theta_n$ and $\phi_n$ is obtained by means of techniques of averaging between the various estimates.

Thus, in the embodiment described, the acquisition device 100 is capable of unambiguously encoding the orientation of a source in space.

By way of variation, the coordinates $\theta_n$ and $\phi_n$ are estimated on the basis of other responses among the $hp_{l,m}(t)$ available or they are estimated in the frequency domain on the basis of the responses $HP_{l,m}(f)$, corresponding to the Fourier transforms of the responses $hp_{l,m}(t)$.

Thus step 30 enables the parameters $r_n$, $\theta_n$ and $\phi_n$ to be determined.

In the embodiment described, the module 93 also provides the transfer function $H_n(f)$ of each element $\mathbf{3}_n$, on the basis of the responses $hp_{l,m}(t)$ coming from the response determination module 92.

A first solution consists in constructing the response $hp'_{0,0}(t)$ corresponding to the selection of the portion of the response $hp_{0,0}(t)$ which includes a non-zero signal free from reflections introduced by the listening site 4. The frequency response $H_n(f)$ is deduced by Fourier transform of the response $hp'_{0,0}(t)$ previously windowed. The window may be selected from among the conventional smoothing windows, such as, for example, the rectangular, Hamming, Hanning, and Blackman windows.

A second, more complex, solution consists in applying smoothing to the module and advantageously to the phase of the frequency response $HP_{0,0}(f)$ obtained by Fourier transform of the response $hp_{0,0}(t)$. For each frequency f, smoothing is obtained by convolution of the response $HP_{0,0}(f)$ by a window centered on f. This convolution corresponds to an averaging of the response $HP_{0,0}(f)$ around the frequency f. The window may be selected from among the conventional windows, such as, for example, rectangular, triangular and Hamming windows. Advantageously, the width of the window varies with the frequency. For example, the width of the window may be proportional to the frequency f at which smoothing is applied. Compared with a fixed window, a window which is variable with the frequency permits the at least partial elimination of the room effect in the high frequencies while at the same time avoiding an effect of truncating the response $HP_{0,0}(f)$ in the low frequencies.

The sub-steps 32 to 39 are repeated for all of the elements $\mathbf{3}_1$ to $\mathbf{3}_N$ of the reproduction unit 2.

By way of variation, the calibration means comprise other means of acquiring data relating to the elements $\mathbf{3}_1$ to $\mathbf{3}_N$, such as laser position-measuring means, means for processing the signal which use techniques of path formation or any other appropriate means.

The means implementing calibration step 30 are constituted, for example, by an electronic card or a computer program or any other appropriate means.

As stated above, step 40 permits the determination of the parameters describing the format of the multi-channel input signal and especially the general predetermined directions associated with each channel.

This step 40 may correspond to a selection, by an operator, of a format from a list of formats which are each associated with parameters stored in the memory, and may also correspond to automatic format detection carried out on the multi-channel input signal. Alternatively, the method is adapted to a single given multi-channel signal format. In yet another embodiment, step 40 enables a user to specify his own format by manually acquiring the parameters describing the directions associated with each channel.

It appears that steps 20, 30 and 40 forming the parameter determination step 10 permit at least the determination of parameters for the positioning in space of the elements $\mathbf{3}_n$ of the reproduction unit 2 and of the format of the multi-channel signal SI.

Figure 7:
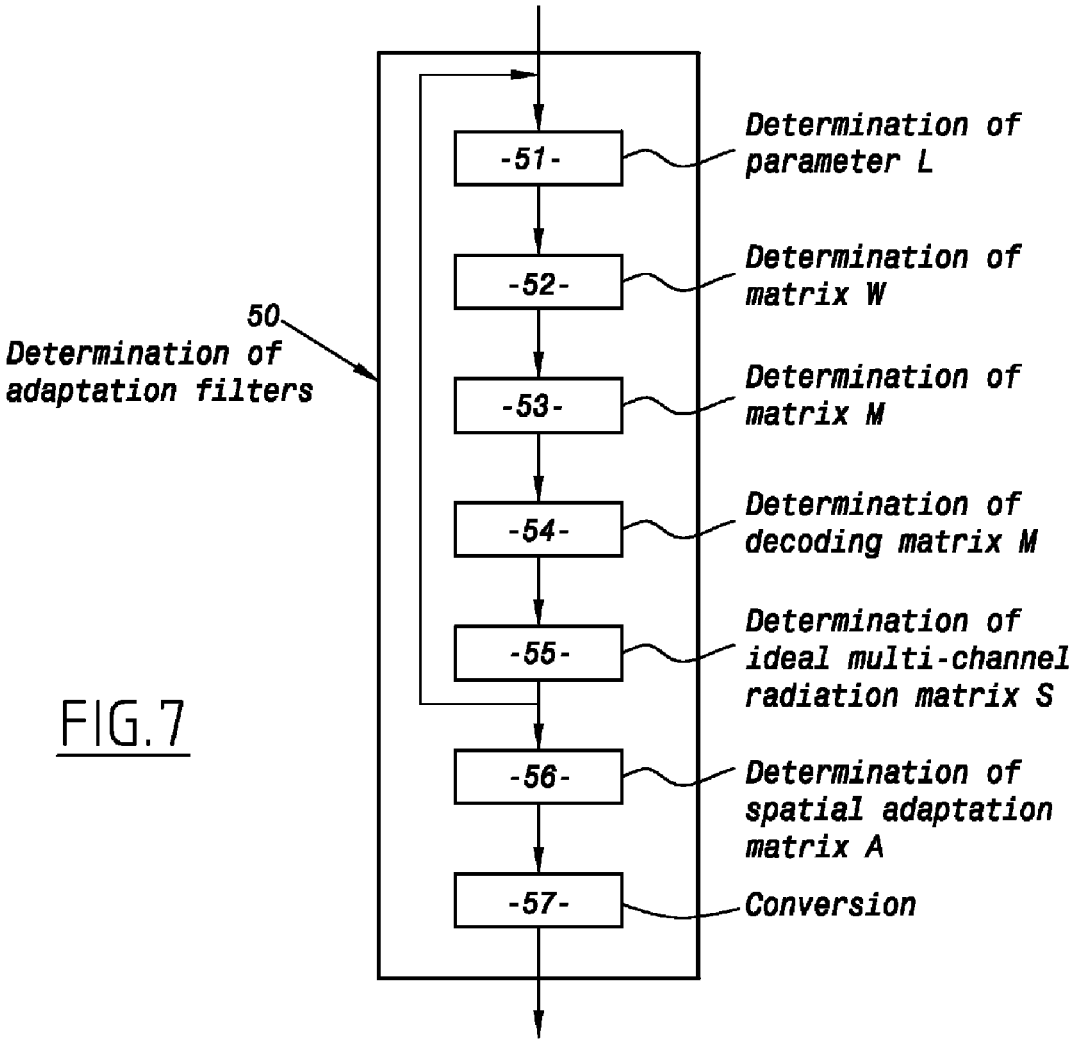
FIG. 7 is a detailed flow chart of the step for determining adaptation filters.

FIG. 7 shows a detailed flow chart of step 50 for determining the adaptation filters.

This step comprises a plurality of sub-steps for calculating and determining matrices representative of the parameters determined previously.

Thus, in a sub-step 51, a parameter L, called the limit order representative of the spatial precision desired in step 50 for determining the adaptation filters, is determined, for example, in the following manner:

the smallest angle $a_{min}$ formed by a pair of elements of the reproduction unit 2 is calculated automatically by means of a trigonometric relationship, such as, for example:

$$a_{n1*,n2*}=a\cos(\sin\theta_{n1}\sin\theta_{n2}\cos(\phi_{n1}-\phi_{n2})+\cos\theta_{n1}\cos\theta_{n2})$$

$$a_{min}=\min(a_{n1,n2})$$

among the set of pairs (n1, n2), such as n1≠n2; and then, the maximum order L is determined automatically as being the largest integer complying with the following relationship:

$$L<\pi/a_{min}.$$

Step 50 for determining adaptation filters then comprises a sub-step 52 for determining a matrix W for weighting the sound field. This matrix W corresponds to a spatial window W(r,f) representative of the distribution in space of the precision desired during the reconstruction of the field. Such a window enables the size and shape of the region where the field is to be correctly reconstructed to be specified. For example, it may be a ball centred on the centre 5 of the reproduction unit. In the embodiment described, the spatial window and the matrix W are independent of the frequency.

W is a diagonal matrix of size $(L+1)^2$ which contains weighting coefficients $W_l$ and in which each coefficient $W_l$ is found 2l+1 times in succession on the diagonal. The matrix W therefore has following form:

$$W=\begin{bmatrix} W_0 & 0 & \cdots & \cdots & \cdots & \cdots & \cdots & 0 \\ 0 & W_1 & \ddots & & & & & \vdots \\ \vdots & \ddots & W_1 & \ddots & & & & \vdots \\ \vdots & & \ddots & W_1 & \ddots & & & \vdots \\ \vdots & & & \ddots & \ddots & \ddots & & \vdots \\ \vdots & & & & \ddots & W_L & \ddots & \vdots \\ \vdots & & & & & \ddots & \ddots & 0 \\ 0 & \cdots & \cdots & \cdots & \cdots & \cdots & 0 & W_L \end{bmatrix}$$

In the embodiment described, the values assumed by the coefficients $W_l$ are the values of a function such as a Hamming window of size 2L+1 evaluated in l, so that the parameter $W_l$ is determined for l ranging from 0 to L.

Step 50 then comprises a sub-step 53 for determining a matrix M representative of the radiation of the reproduction unit, especially on the basis of the position parameters $\vec{x}_n$. The radiation matrix M makes it possible to deduce Fourier-Bessel coefficients representing the sound field emitted by each element $\mathbf{3}_n$ of the reproduction unit as a function of the signal which it receives.

M is a matrix of size $(L+1)^2$ by N, constituted by elements $M_{l,m,n}$, the indices l,m denoting the row $l^2+l+m$ and n denoting the column n. The matrix M therefore has the following form:

$$\begin{bmatrix} M_{0,0,1} & M_{0,0,2} & \cdots & M_{0,0,N} \\ M_{1,-1,1} & M_{1,-1,2} & \cdots & M_{1,-1,N} \\ M_{1,0,1} & M_{1,0,2} & \cdots & M_{1,0,N} \\ M_{1,1,1} & M_{1,1,2} & \cdots & M_{1,1,N} \\ \vdots & \vdots & & \vdots \\ M_{L,-L,1} & M_{L,-L,2} & \cdots & M_{L,-L,N} \\ \vdots & \vdots & & \vdots \\ M_{L,0,1} & M_{L,0,2} & \cdots & M_{L,0,N} \\ \vdots & \vdots & & \vdots \\ M_{L,L,1} & M_{L,L,2} & \cdots & M_{L,L,N} \end{bmatrix}$$

In the embodiment described, the elements $M_{l,m,n}$ are obtained on the basis of a plane wave radiation model, with the result that:

$$M_{l,m,n}=y_l^m(\theta_n,\phi_n)$$

The matrix M thus defined is representative of the radiation of the reproduction unit. In particular, M is representative of the spatial configuration of the reproduction unit.

The sub-steps 51 to 53 may be performed sequentially or simultaneously.

Step 50 for determining adaptation filters then comprises a sub-step 54 for taking into account the set of parameters of the reproduction system 2 which were determined previously, in order to provide a decoding matrix D representative of so-called reconstruction filters.

The elements $D_{n,l,m}(f)$ of the matrix D correspond to reconstruction filters which, when applied to the Fourier-Bessel coefficients $P_{l,m}(f)$ of a known sound field, permit the determination of the signals for controlling a reproduction unit in order to reproduce this sound field.

The decoding matrix D is therefore the inverse of the radiation matrix M.

Matrix D is obtained from matrix M by means of inversion methods under constraints which involve supplementary optimization parameters.

In the embodiment described, step 50 is suitable for carrying out an optimization operation thanks to the matrix for weighting the sound field W which, in particular, enables the spatial distortion in the reproduced sound field to be reduced.

This matrix D is provided especially from matrix M, in accordance with the following expression:

$$D=(M^TWM)^{-1}M^TW$$

in which $M^T$ is the conjugated transposed matrix of M.

In the embodiment described, the matrices M and W are independent of the frequency, so that the matrix D is likewise independent of the frequency. The matrix D is constituted by elements indicated $D_{n,l,m}$ organized in the following manner:

$$\begin{bmatrix} D_{1,0,0} & D_{1,1,-1} & D_{1,1,0} & D_{1,1,1} & \cdots & D_{1,L,-L} & \cdots & D_{1,L,0} & \cdots & D_{1,L,L} \\ D_{2,0,0} & D_{2,1,-1} & D_{2,1,0} & D_{2,1,1} & \cdots & D_{2,L,-L} & \cdots & D_{2,L,0} & \cdots & D_{2,L,L} \\ \vdots & \vdots & \vdots & \vdots & & \vdots & & \vdots & & \vdots \\ D_{N,0,0} & D_{N,1,-1} & D_{N,1,0} & D_{N,1,1} & \cdots & D_{N,L,-L} & \cdots & D_{N,L,0} & \cdots & D_{N,L,L} \end{bmatrix}$$

Step 54 thus enables the matrix D representative of so-called reconstruction filters and permitting the reconstruction of a sound field on the basis of any configuration of the reproduction unit to be provided. Owing to this matrix, the method of the invention makes it possible to take into account the configuration of the reproduction unit 2 and, in particular, to compensate for the alterations in the sound field caused by its specific spatial configuration.

By way of variation, the parameters relating to the reproduction unit 2 may be variable as a function of the frequency.

For example, in such an embodiment, each element $D_{n,l,m}(f)$ of the matrix D can be determined by associating with each of the N control signals a directivity function $D_n(\theta,\phi,f)$ specifying at each frequency f the amplitude and, advantageously, the phase desired on the control signal $sc_n$ in the case of a plane wave in the direction $(\theta,\phi)$.

A directivity function $D_n(\theta,\phi,f)$ means a function which associates a real or complex value, which is optionally a function of the frequency or a range of frequencies, with each spatial direction.

In the embodiment described, the directivity functions are independent of the frequency and are indicated $D_n(\theta,\phi)$.

These directivity functions $D_n(\theta,\phi)$ can be determined by specifying that specific physical quantities between an ideal field and the same field reproduced by the reproduction unit comply with predetermined laws. For example, these quantities may be the pressure at the centre and the orientation of the velocity vector. In some cases, it is desired that only 3 control signals should be active in reproducing a plane wave. The active control signals, indicated $sc_{n1}$ to $sc_{n3}$, are those which supply the reproduction elements whose directions are closest to the direction $(\theta,\phi)$ of the plane wave. The active reproduction elements, indicated $\mathbf{3}_{n1}$ to $\mathbf{3}_{n3}$, form a triangle containing the direction $(\theta,\phi)$ of the plane wave. In that case, the values of the directivities $D_{n1}(\theta,\phi)$ to $D_{n3}(\theta,\phi)$ associated with the 3 active elements $\mathbf{3}_{n1}$ to $\mathbf{3}_{n3}$ are given by:

$$\alpha = \frac{\Gamma^{-1} r}{1^{\tau}\Gamma^{-1} r}$$

with $$\Gamma = \begin{pmatrix} \sin\theta_{n_1}\cos\phi_{n_1} & \sin\theta_{n_2}\cos\phi_{n_2} & \sin\theta_{n_3}\cos\phi_{n_3} \\ \sin\theta_{n_1}\sin\phi_{n_1} & \sin\theta_{n_2}\sin\phi_{n_2} & \sin\theta_{n_3}\sin\phi_{n_3} \\ \cos\theta_{n_1} & \cos\theta_{n_2} & \cos\theta_{n_3} \end{pmatrix}$$

$$r = \begin{pmatrix} \sin\theta\cos\phi \\ \sin\theta\sin\phi \\ \cos\theta \end{pmatrix}$$

$$1 = \begin{pmatrix} 1 \\ 1 \\ 1 \end{pmatrix}$$

In this relationship, a corresponds to the vector containing $[D_{n1}(\theta,\phi) \ldots D_{n3}(\theta,\phi)]$ and the directions $(\theta_{n1},\phi_{n1})$, $(\theta_{n2},\phi_{n2})$ and $(\theta_{n3},\phi_{n3})$ correspond to the directions of the elements $\mathbf{3}_{n1}$, $\mathbf{3}_{n2}$ and $\mathbf{3}_{n3}$, respectively.

The values of the directivities $D_n(\theta,\phi)$ corresponding to the non-active reproduction elements are considered to be zero.

The previous relationship is repeated for K directions $(\theta_k, \phi_k)$ of different plane waves. Thus, each of the directivity functions $D_n(\theta,\phi)$ is supplied in the form of a list of K samples. Each sample is supplied in the form of a pair $\{((\theta_k, \phi_k), D_n(\theta_k,\phi_k))\}$ where $(\theta_k,\phi_k)$ is the direction of the sample k and where $D_n(\theta_k,\phi_k)$ is the value of the directivity function associated with the control signal $sc_n$ for the direction $(\theta_k,\phi_k)$.

For each frequency f the coefficients $D_{n,l,m}(f)$ of each directivity function are deduced from the samples $\{((\theta_k,\phi_k), D_n(\theta_k, \phi_k))\}$. These coefficients are obtained by inverting the angular sampling process which permits deduction of the samples from the list $\{((\theta_k,\phi_k), D_n(\theta_k,\phi_k))\}$ on the basis of a directivity function supplied in the form of spherical harmonic coefficients. This inversion may assume different forms in order to control the interpolation between the samples.

In other embodiments, the directivity functions are supplied directly in the form of coefficients $D_{n,l,m}(f)$ of the Fourier-Bessel type.

The coefficients $D_{n,l,m}(f)$ thus determined are used to form the matrix D.

Step 50 then comprises a step 55 for determining an ideal multi-channel radiation matrix S representative of the predetermined general directions associated with each channel of the multi-channel input signal SI.

The matrix S is representative of the radiation of an ideal reproduction unit, that is to say, complying exactly with the predetermined general directions of the multi-channel format. Each element $S_{l,m,q}(f)$ of the matrix S enables the Fourier-Bessel coefficients $P_{l,m}(f)$ of the sound field ideally reproduced by each channel $c_q(t)$. to be deduced.

The matrix S is determined by associating with each input channel $c_q(t)$ and advantageously for each frequency f, a directivity pattern representative of a distribution of sources assumed to emit the signal of the channel $c_q(t)$.

The distribution of sources is given in the form of spherical harmonic coefficients $S_{l,m,q}(f)$. The coefficients $S_{l,m,q}(f)$ are arranged in the matrix S of size $(L+1)^2$ over Q, where Q is the number of channels.

In the embodiment described, the formatting step associates with each channel $c_q(t)$ a plane wave source oriented in the direction $(\theta_q,\phi_q)$ corresponding to the direction $(\theta_q^c,\phi_q^c)$ associated with the channel $c_q(t)$ in the multi-channel input format. The coefficients $S_{l,m,q}(f)$ are therefore independent of the frequency. They are indicated $S_{l,m,q}$ and are obtained by the relationship:

$$S_{l,m,q}=y_l^m(\theta_q,\phi_q)$$

In other embodiments, the ideal radiation matrix S associates a discrete distribution of plane wave sources with specific channels in order to simulate the effect of a ring of loudspeakers. In that case, the coefficients $S_{l,m,q}$ are obtained by adding up the contributions of each of the elemental sources.

In yet other embodiments, the ideal radiation matrix S associates specific channels $c_q(t)$ with a continuous distribution of plane wave sources which is described by a directivity function $S_q(\theta,\phi)$. In that case, the coefficients $S_{l,m,q}$ of the matrix S are obtained directly by spherical Fourier transform of the directivity function $S_q(\theta,\phi)$. In these embodiments, the matrix S is independent of the frequency.

In other, more complex, embodiments, the matrix S associates with specific channels a distribution of sources producing a diffuse field. In that case, the matrix S varies with the frequency. These embodiments are suitable for multi-channel formats that consider the front and rear channels differently. For example, in applications intended for reproduction in cinema rooms, the rear channels are often intended to recreate a diffuse ambience.

In other embodiments, the matrix S associates with specific channels sound sources whose response is not flat. For example, if the multi-channel format associates with the channel $c_q(t)$ a plane wave source having the frequency response $H^{(q)}(f)$, the $S_{l,m,q}(f)$ vary with the frequency and are obtained by the relationship:

$$S_{l,m,q}(f)=y_l^m(\theta_q,\phi_q)H^{(q)}(f)$$

If the multi-channel format associates with specific channels a superposition of the above-mentioned types of source distribution, the coefficients $S_{l,m,q}(f)$ of the radiation matrix are obtained by adding up the coefficients associated with each type of source distribution.

Finally, step 50 includes a sub-step 56 for determining a spatial adaptation matrix A corresponding to the adaptation filters to be applied to the multi-channel input signal in order to obtain optimum reproduction taking into account the spatial configuration of the reproduction unit 2.

The spatial adaptation matrix A is obtained from the matrices for shaping S and decoding D by means of the relationship:

$$A=DS$$

The adaptation matrix A permits the generation of signals $sa_1(t)$ to $sa_N(t)$ adapted to the spatial configuration of the reproduction unit using the channels $c_1(t)$ to $c_Q(t)$. Each element $A_{n,q}(f)$ is a filter specifying the contribution of the channel $c_q(t)$ to the adapted signal $sa_n(t)$. Owing to the adaptation matrix A, the method of the invention permits optimum reproduction of the sound field described by the multi-channel signal by a reproduction unit having any spatial configuration.

In the embodiment described, the matrices D and S are independent of the frequency, as is also the matrix A. In that case, the elements of the matrix A are constants indicated $A_{n,q}$ and each of the adapted signals $sa_1(t)$ to $sa_N(t)$ is obtained by simple linear combinations of the input channels $c_1(t)$ to $c_Q(t)$, where appropriate followed by a delay as will be described hereinafter.

The filters represented by the matrix A may be used in a different form and/or in different filtering methods. If the filters used are parameterized directly with frequency responses, the coefficients $A_{n,q}(f)$ are provided directly by step 50. Advantageously, step 50 for determining adaptation filters comprises a conversion sub-step 57 in order to determine the parameters of the filters for other filtering methods.

For example, the filtering combinations $A_{n,q}(f)$ are converted into:

- finite impulse responses $a_{n,q}(t)$ calculated by inverse temporal Fourier transform of $A_{n,q}(f)$, each impulse response $a_{n,q}(t)$ is sampled and then truncated to a length suitable for each response; or
- coefficients of recursive filters having infinite impulse responses calculated from the $A_{n,q}(f)$ with adaptation methods.

At the end of step 50, the parameters of the adaptation filters $A_{n,q}(f)$ are provided.

As stated above, step 60 permits the determination of the filters for compensating for the sound characteristics of the elements of the reproduction unit 2 in the case where parameters relating to those sound characteristics, such as the frequency responses $H_n(f)$, are determined in step 10 for determining the parameters.

The determination of such filters, indicated $H_n^{(I)}(f)$, using frequency responses $H_n(f)$, can be carried out in a conventional manner by applying filter inversion methods, such as, for example, direct inversion, deconvolution methods, Wiener methods or the like.

As a function of the embodiments, the compensation relates solely to the amplitude of the response or also to the amplitude and the phase.

This step 60 permits the determination of a compensation filter for each element $\mathbf{3}_n$ of the reproduction unit 2 as a function of its specific sound characteristics.

As above, these filters may be used in a different form and/or in different filtering methods. If the filters used are parameterized directly with frequency responses, the responses $H_n^{(I)}(f)$ are applied directly. Advantageously, step 60 for determining compensation filters comprises a conversion sub-step in order to determine the parameters of the filters for other filtering methods.

For example, the filtering combinations $H_n^{(I)}(f)$ are converted into:

- finite impulse responses $h_n^{(I)}(t)$ calculated by inverse temporal Fourier transform of $H_n^{(I)}(f)$, each impulse response $h_n^{(I)}(t)$ is sampled and then truncated to a length suitable for each response; or
- coefficients of recursive filters having infinite impulse responses calculated using the $H_n^{(I)}(f)$ (with adaptation methods.

At the end of step 60, the parameters of the compensation filters $H_n^{(I)}(f)$ are supplied.

Step 70 for determining control signals will now be described in more detail.

This step 70 comprises a sub-step 80 for applying the adaptation filters represented by the matrix A to the multi-channel input signal SI corresponding to the sound field to be reproduced. As stated above, the adaptation filters $A_{n,q}(f)$ incorporate the parameters characteristic of the reproduction unit 2.

In sub-step 80, adapted signals $sa_1(t)$ to $sa_N(t)$ are obtained by applying the adaptation filters $A_{n,q}(f)$ to the channels $c_1(t)$ to $c_Q(t)$ of the signal SI.

In the embodiment described, the adaptation matrix A is independent of the frequency and the adaptation coefficients $A_{n,q}$ are applied in the following manner:

$$v_n(t) = \sum_{q=1}^{Q} c_q(t) A_{n,q}$$

The adaptation continues with an adjustment to the gains and the application of delays in order to align temporally the wavefronts of the elements $\mathbf{3}_1$ to $\mathbf{3}_N$ of the reproduction unit 2 relative to the furthermost element. The adapted signals $sa_1(t)$ to $sa_N(t)$ are deduced from the signals $v_1(t)$ to $v_N(t)$ in accordance with the expression:

$$sa_n(t) = r_n\ v_n\left(t - \frac{\max(r_n) - r_n}{c}\right)$$

In other embodiments, the adaptation matrix A varies with the frequency and the adaptation filters $A_{n,q}(f)$ are applied in the following manner:

$$V_n(f) = \sum_{q=1}^{Q} C_q(f) A_{n,q}(f)$$

with $C_q(f)$ denoting the temporal Fourier transform of the channel $c_q(t)$ and $V_n(f)$ being defined by:

$$V_n(f) = \frac{SA_n(f)}{r_n} e^{-2\pi j r_n f/c}$$

where $SA_n(f)$ is the temporal Fourier transform of $sa_n(t)$.

Depending on the form of the parameters of the adaptation filters $A_{n,q}(f)$, each filtering of the channels $c_q(t)$ by the adaptation filters $A_{n,q}(f)$ can be carried out in accordance with conventional filtering methods, such as, for example:

- the parameters are directly the frequency responses $A_{n,q}(f)$, and the filtering is carried out in the frequency domain, for example, using the usual techniques of block convolution;
- the parameters are directly the finite impulse responses $a_{n,q}(t)$, and the filtering is carried out in the temporal domain by convolution; or
- the parameters are the coefficients of infinite impulse response recursive filters, and the filtering is carried out in the temporal domain by means of recurrence relations.

Sub-step 80 is terminated by an adjustment to the gains and the application of delays in order to align temporally the wavefronts of elements $\mathbf{3}_1$ to $\mathbf{3}_N$ of the reproduction unit 2 relative to the furthermost element. The adapted signals $sa_1(t)$ to $sa_N(t)$ are deduced from the signals $v_1(t)$ to $v_N(t)$ in accordance with the expression:

$$sc_n(t) = r_n\ v_n\left(t - \frac{\max(r_n) - r_n}{c}\right)$$

Figure 8:
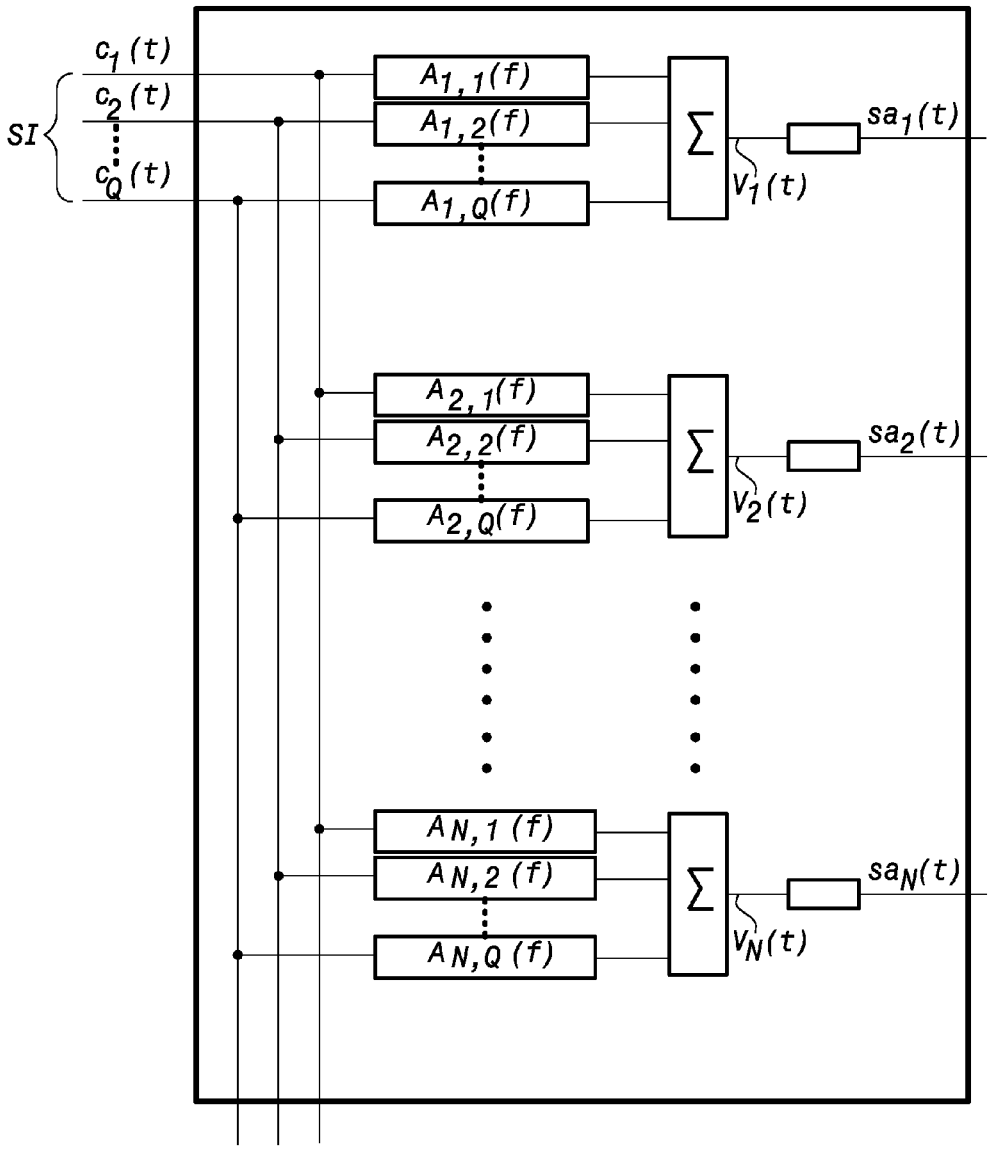
FIGS. 8 and 9 are diagrams of means for determining control signals.

FIG. 8 shows the filtering structure corresponding to sub-step 80 for applying the filters for spatial adaptation as described above.

Advantageously, step 70 comprises a sub-step 90 for compensating for the sound characteristics of the reproduction unit. Each compensation filter $H_n^{(l)}(f)$ is applied to the corresponding adapted signal $sa_n(t)$ in order to obtain the control signal $sc_n(t)$ of the element $\mathbf{3}_n$, in accordance with the relationship:

$$SC_n(f)=SA_n(f)H_n^{(l)}(f)$$

where $SC_n(f)$ is the temporal Fourier transform of $sc_n(t)$ and where $SA_n(t)$ is the temporal Fourier transform of $sa_n(t)$.

Figure 9:
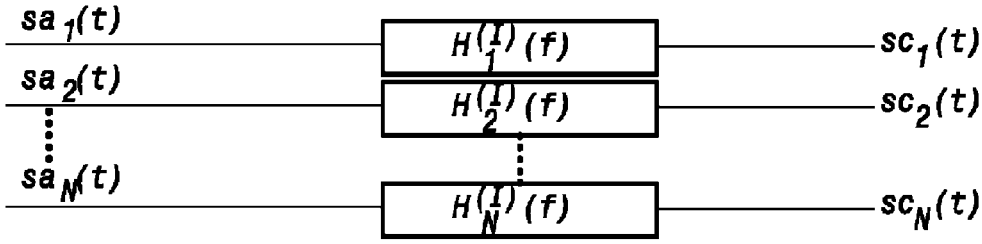

The application of the sound characteristic compensation filters $H_n^{(l)}(f)$ is described with reference to FIG. 9.

Depending on the form of the parameters of these filters, each filtering of the signals $sa_n(t)$ can be carried out in accordance with conventional filtering methods, such as, for example:

- if the filtering parameters are frequency responses $H_n^{(l)}(f)$, the filtering can be carried out by means of filtering methods in the frequency domain, such as, for example, block convolution techniques;
- if the filtering parameters are impulse responses $h_n^{(l)}(t)$, the filtering can be carried out in the temporal domain by temporal convolution;
- if the filtering parameters are recurrence relation coefficients, the filtering can be carried out in the temporal domain by means of infinite impulse response recursive filters.

In some simplified embodiments, the method of the invention does not compensate for the specific sound characteristics of the elements of the reproduction unit. In that case, step 60 as well as sub-step 90 are not carried out and the adapted signals $sa_1(t)$ to $sa_N(t)$ correspond directly to the control signals $sc_1$ to $sc_N$.

By applying the method of the invention, each element $\mathbf{3}_1$ to $\mathbf{3}_N$ therefore receives a specific control signal $sc_1$ to $sc_N$ and emits a sound field which contributes to the optimum reconstruction of the sound field to be reproduced. The simultaneous control of the set of elements $\mathbf{3}_1$ to $\mathbf{3}_N$ permits optimum reconstruction of the sound field corresponding to the multi-channel input signal by the reproduction unit 2 whose spatial configuration may be as desired, that is to say, does not correspond to a fixed configuration.

In addition, other embodiments of the method of the invention may be envisaged and, in particular, embodiments inspired by techniques described in the French patent application filed on 28 Feb. 2002 under number 02 02 585.

In particular, step 50 for determining the spatial adaptation filters may take into account numerous optimization parameters, such as:

- $G_n(f)$, representative of the template of element $\mathbf{3}_n$ of the reproduction unit specifying the operating frequency band of this element;
- $N_{l,m,n}(f)$, representative of the spatio-temporal response of element $\mathbf{3}_n$ corresponding to the sound field produced in the listening site 4 by the element $\mathbf{3}_n$, when the latter receives an impulse signal as an input;
- W(r,f), describing, for each frequency f considered, a spatial window representative of the distribution in space of sound field reconstruction constraints, these constraints enabling the distribution in space of the effort for reconstructing the sound field to be specified;
- $W_l(f)$, describing directly in the form of a weighting of the Fourier-Bessel coefficients and for each frequency f considered, a spatial window representative of the distribution in space of constraints in respect of the reconstruction of the sound field;
- R(f), representative, for each frequency f considered, of the radius of the spatial window when the latter is a ball;
- μ(f), representative, for each frequency f considered, of the desired local adaptation capacity to the spatial irregularity of the configuration of the reproduction unit;
- $\{(l_k, m_k)\}(f)$, constituting, for each frequency f considered, a list of spatio-temporal functions whose reconstruction is imposed;
- L(f), imposing, for each frequency f considered, the limit order of determination of filters;
- RM(f), defining, for each frequency f considered, the radiation model of the elements $\mathbf{3}_1$ to $\mathbf{3}_N$ of the reproduction unit 2.

All or some of these optimization parameters may be involved in sub-step 54 for determining the decoding matrix D. Thus, as described in the French patent application filed under number 02 02 585, the parameters $N_{l,m,n}(f)$ and RM(f) are involved in sub-step 53 for determining the radiation matrix M, the parameters W(r,f), $W_l(f)$, R(f) are involved in sub-step 52 for determining the matrix W, the parameters $\{(l_k, m_k)\}(f)$ are involved in an additional sub-step in the determination of a matrix F. The decoding matrix D is then determined in sub-step 54, for each frequency f, as a function of the matrices M, W and F and the parameters $G_n(f)$ and μ(f):

Still in accordance with patent application 02 02 585, the calculation of the matrix D can be carried out frequency by frequency by considering solely the active elements for each frequency considered. This method of determining the matrix D involves the parameter $G_n(f)$ and permits optimum exploitation of a reproduction unit whose elements have different operating frequency bands.

It appears that the implementation of the method of the invention described here is more efficient and therefore more rapid than the existing methods and especially than the method described in the French patent application filed under number 02 02 585.

For, in order to adapt a multi-channel signal comprising Q channels to a reproduction unit comprising N elements with a spatial precision of order L, it appears that the method of the invention requires Q×N adaptation filters instead of the $Q(L+1)^2+(L+1)^2N$ filters necessary for implementing the method described in the French patent application filed under number 02 02 585.

For example, the adaptation of a "5.1 ITU-R BF 775-1" signal to a reproduction unit having 5 loudspeakers with a precision of order 5 requires 25 filters instead of 360 filters.

Figure 10:
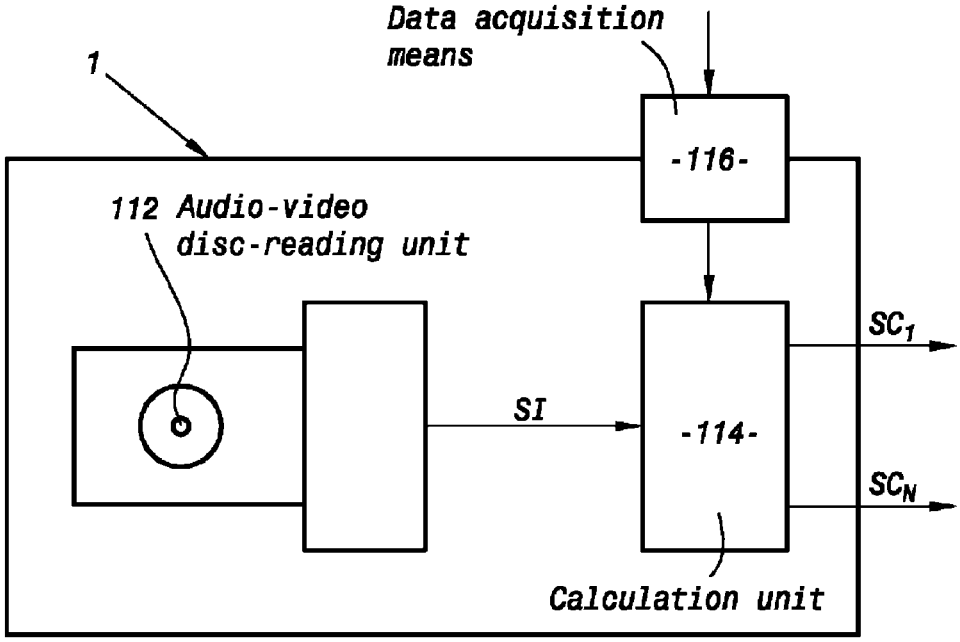
FIG. 10 is a diagram of an embodiment of a device using the method of the invention.

FIG. 10 shows a diagram of an embodiment of an apparatus using the method as described above.

This apparatus comprises the adaptor 1 which is formed by a unit 110 providing a multi-channel signal, such as an audio-video disc-reading unit 112 called a DVD reader. The multi-channel signal provided by the unit 110 is intended for the elements of the reproduction unit 2. The format of this signal SI is recognized automatically by the adaptor 1 which is suitable for causing parameters describing the predetermined general direction associated with each channel of the signal SI to correspond thereto.

According to the invention, this adaptor 1 also incorporates a supplementary calculation unit 114 as well as data acquisition means 116.

For example, the acquisition means 116 are formed by an infrared interface with a remote control or also with a computer and allow a user to determine the parameters defining the positions in space of the reproduction elements $\mathbf{3}_1$ to $\mathbf{3}_N$.

These various parameters are used by the calculator 114 to determine the matrix A defining the adaptation filters.

Subsequently, the calculator 114 applies these adaptation filters to the multi-channel signal SI in order to provide the control signals $sc_1$ to $sc_N$ intended for the reproduction unit 2.

It will be appreciated that the device implementing the invention may assume other forms, such as software used in a computer or a complete device incorporating calibration means as well as means for the acquisition and determination of the characteristics of the more complete reproduction unit.

Thus, the method may also be used in the form of a device dedicated to the optimization of multi-channel reproduction systems, outside an audio-video decoder and associated therewith. In that case, the device is suitable for receiving as an input a multi-channel signal and for providing as an output control signals for elements of a reproduction unit.

Advantageously, the device is suitable for being connected to the acquisition device 100 necessary for the calibration step and/or is provided with an interface permitting the acquisition of parameters, in particular the position of the elements of the reproduction unit and optionally the multi-channel input format.

Such an acquisition device 100 may be connected in a wired or wireless manner (radio, infra-red) and may be incorporated in an accessory, such as a remote control, or may be independent.

The method may be implemented by a device incorporated in an element of an audio-video chain, which element has the task of processing multi-channel signals, such as, for example, a so-called "surround" processor or decoder, an audio-video amplifier incorporating multi-channel decoding functions or also a completely integrated audio-video chain.

The method of the invention may also be implemented in an electronic card or in a dedicated chip. Advantageously, it may be incorporated in the form of a program in a signal processor (DSP).

The method may assume the form of a computer program which is to be performed by a computer. The program receives as an input a multi-channel signal and provides the control signals for a reproduction unit which is optionally incorporated in the computer.

In addition, the calibration means may be produced using a method other than that described above, such as, for example, a method inspired by techniques described in the French patent application filed on 7 May 2002 under number 02 05 741.

The invention claimed is:

1. A method for controlling an acoustic field reproduction unit comprising a plurality of reproduction elements having any position and direction using a plurality of sound data input signals each associated with any predetermined general reproduction direction defined relative to a given point in space, comprising:

determining via a computer parameters from a multi-channel audio signal of the sound data input signals describing the reproduction direction of each channel of the multi-channel audio signal, determining via a computer at least spatial characteristics of the reproduction unit, the spatial characteristics comprising at least the direction of each reproduction element having any position and direction in the three spatial dimensions relative to the given point, wherein the determined directions of the reproduction elements having any position and direction are different from the reproduction directions of the multi-channel audio signal, determining via a computer a spatial adaptation matrix using the determined directions of the reproduction elements and the parameters describing the reproduction directions, wherein the spatial adaptation matrix is determined such that controlling the reproduction elements with the controlling signals reproduces, in a region comprising the given point, the acoustic field that would have been obtained by controlling, with the multi-channel audio signal, ideal reproduction elements which would exactly comply with the reproduction directions of the multi-channel audio signal.

2. The method according to claim 1, wherein the determining at least spatial characteristics of the reproduction unit comprises an acquisition sub-step enabling all or some of the characteristics of the reproduction unit to be determined.

3. The method according to claim 1, wherein the determining at least spatial characteristics of the reproduction unit comprises a calibration step enabling all or some of the characteristics of the reproduction unit to be provided.

4. The method according to claim 3, wherein the calibration sub-step comprises, in the case of at least one of the reproduction elements:

a sub-step for transmitting a specific signal ($u_n(t)$) to the at least one element of the reproduction unit;

a sub-step for acquiring the sound wave emitted in response by the at least one element;

a sub-step for converting the acquired signals into a finite number of coefficients representative of the emitted sound wave; and a sub-step for determining spatial and/or sound parameters of the element on the basis of the coefficients representative of the emitted sound wave.

5. The method according to claim 3, wherein the calibration sub-step (30) also comprises a sub-step for determining the position in at least one of the three spatial dimensions of the at least one element of the reproduction unit.

6. The method according to claim 3, wherein the calibration step (30) comprises a sub-step for determining the frequency response ($H_n(f)$) of the at least one element of the reproduction unit.

7. The method according to claim 1, wherein step for determining adaptation filters comprises:

a sub-step for determining a decoding matrix (D) representative of filters permitting compensation for the changes in reproduction caused by the spatial characteristics of the reproduction unit;

a sub-step for determining an ideal multi-channel radiation matrix representative of the predetermined general directions associated with each data signal of the plurality of input signals; and a sub-step for determining a matrix representative of the adaptation filters using the decoding matrix (D) and the multi-channel radiation matrix.

8. The method according to claim 7, wherein the step for determining adaptation filters comprises a plurality of calculation sub-steps permitting the provision of a limit order of the spatial precision of the adaptation filters, a matrix corresponding to a spatial window representative of the distribution in space of the desired precision during the reconstruction of the sound field, and a matrix representative of the radiation of the reproduction unit, the sub-step for calculating the decoding matrix being carried out using the results of these calculation sub-steps.

9. The method according to claim 7, wherein the matrices for decoding, ideal multi-channel radiation and adaptation are independent of the frequency, step for determining at least one signal for controlling the elements of the reproduction unit by applying the adaptation filters corresponding to simple linear combinations followed by a delay.

10. The method according to claim 1, wherein the step for determining characteristics of the reproduction unit permits the determination of sound characteristics of the reproduction unit and in that the method comprises a step for determining filters for compensating for these sound characteristics, the step for determining at least one control signal then comprising a sub-step for applying the sound compensation filters.

11. The method according to claim 10, wherein the step for determining sound characteristics is suitable for providing parameters representative, in the case of at least one element, of its frequency response.

12. The method according to claim 1, wherein the step for determining at least one control signal comprises a sub-step for adjusting the gain and applying delays in order to align temporally the wavefront of the reproduction elements as a function of their distance from the given point.

13. The computer program comprising program code instructions for performing the steps of the method according to claim 1 when the program is performed by a computer.

14. The removable medium of the type comprising at least one processor and a non-volatile memory element, wherein the memory comprises a program comprising code instructions for performing the steps of the method according to claim 1, when the processor performs the program.

15. A device for controlling an acoustic field reproduction unit comprising a plurality of reproduction elements having any position or direction using a plurality of sound data input signals each associated with any predetermined general reproduction direction defined relative to a given point, comprising:

means for determining parameters from a multi-channel audio signal of the sound data input signals describing the reproduction direction of each channel of the multi-channel audio signal, means (116) for determining at least spatial characteristics of the reproduction unit (2), the spatial characteristics comprising at least the direction of each reproduction element having any position and direction in the three spatial dimensions relative to the given point, wherein the determined directions of the reproduction elements having any position and direction are different from the reproduction directions of the multi-channel audio signal, means (114) for determining spatial adaptation matrix using the determined directions of the reproduction elements and the parameters describing the reproduction directions, means for determining a controlling signal for each reproduction element, by applying the adaptation matrix to the multi-channel audio signal, wherein the spatial adaptation matrix is determined such that controlling the reproduction elements with the controlling signals reproduces, in a region comprising the given point, the acoustic field that would have been obtained by controlling, with the multi-channel audio signal, ideal reproduction elements which would exactly comply with the reproduction directions of the multi-channel audio signal.

16. The device according to claim 15, wherein the means for determining the at least spatial characteristics of the reproduction unit comprise means for the direct acquisition of the characteristics.

17. The device according to claim 15, wherein it is suitable for being associated with calibration means permitting the determination of the at least spatial characteristics of the reproduction unit.

18. The device according to claim 17, wherein the calibration means comprise means for acquiring a sound wave which comprise four pressure sensors arranged in accordance with a general tetrahedral shape.

19. The device according to claim 15, wherein the means for determining characteristics are suitable for determining sound characteristics of at least one of the elements of the reproduction unit, the device comprising means for determining sound compensation filters using the sound characteristics, and the means for determining at least one control signal being suitable for the application of the sound compensation filters.

20. The device according to claim 19, wherein the means for determining the sound characteristics are suitable for determining the frequency response of the elements of the reproduction unit.

21. An apparatus for processing audio and video data, comprising means for determining a plurality of sound data input signals each associated with a predetermined general reproduction direction defined by a given point, wherein it also comprises a device for controlling a reproduction unit according to claim 1.

22. The apparatus according to claim 21, wherein the means for determining a plurality of input signals are formed by a unit for reading and decoding digital audio and/or video discs.

23. The method according to claim 1, wherein the spatial characteristics of the reproduction unit are determined without using the multi-channel audio signal.

24. The method according to claim 1, wherein the spatial adaptation matrix is determined without using the multi-channel audio signal.

25. The method according to claim 1, wherein, when being applied, the spatial adaptation matrix remains as it has been determined.

26. The device according to claim 15, wherein the spatial characteristics of the reproduction unit are determined without using the multi-channel audio signal.

27. The device according to claim 15, wherein the spatial adaptation matrix is determined without using the multi-channel audio signal.

28. The device according to claim 15, wherein, when being applied, the spatial adaptation matrix remains as it has been determined.

* * * * *